US009708786B2

(12) United States Patent
James

(10) Patent No.: US 9,708,786 B2
(45) Date of Patent: Jul. 18, 2017

(54) INFLATABLE FLOOD DEFENSE STRUCTURAL UNIT AND ARRANGEMENT

(71) Applicant: CINTEC INTERNATIONAL LIMITED, Newport (GB)

(72) Inventor: Peter James, Chepstow (GB)

(73) Assignee: Cintec International Limited, Newport, Gwent (GB)

( * ) Notice: Subject to any disclaimer, the term of this patent is extended or adjusted under 35 U.S.C. 154(b) by 0 days.

(21) Appl. No.: 14/783,497

(22) PCT Filed: Apr. 7, 2014

(86) PCT No.: PCT/GB2014/051073
§ 371 (c)(1),
(2) Date: Oct. 9, 2015

(87) PCT Pub. No.: WO2014/167301
PCT Pub. Date: Oct. 16, 2014

(65) Prior Publication Data

US 2016/0060836 A1 Mar. 3, 2016

(30) Foreign Application Priority Data

Apr. 9, 2013 (GB) ..... 1306366.4

(51) Int. Cl.
*E02B 3/10* (2006.01)
*E02B 7/00* (2006.01)

(52) U.S. Cl.
CPC ..... *E02B 3/108* (2013.01); *E02B 7/005* (2013.01)

(58) Field of Classification Search
CPC ..... E02B 3/106; E02B 3/108; E02B 3/127; E02B 7/005
(Continued)

(56) References Cited

U.S. PATENT DOCUMENTS 5,040,919 A * 8/1991 Hendrix ..... E02B 3/108 405/115
5,059,065 A 10/1991 Doolaege
(Continued)

FOREIGN PATENT DOCUMENTS

DE 202006005602 U1 7/2006
GB 183615 A * 8/1922 ..... E02B 3/06
(Continued)

OTHER PUBLICATIONS

International Search Report and Written Opinion under date of mailing of Aug. 11, 2014 in connection with PCT/GB2014/051073.
(Continued)

*Primary Examiner* — Frederick L Lagman
(74) *Attorney, Agent, or Firm* — Quarles & Brady LLP

(57) ABSTRACT

An inflatable flood defence structural unit is described for creating an inflatable flood defence arrangement. The unit comprises at least one inflatable chamber comprising a front wall and a rear wall which extend in a substantially parallel orientation. At least one of the front and rear walls provide a water barrier, and a first and second end wall are arranged to couple the front and rear walls together at a respective first and second end of the front and rear walls. The unit further comprises a first inflatable buttress which is rigidly bonded at a proximal end thereof to the rear wall of the chamber, proximate the first end of the chamber and which extends in a direction which is away from the chamber, and a second inflatable buttress which is rigidly bonded at a proximal end thereof to the rear wall of the chamber, proximate the second end of the chamber, and which similarly extends in a direction which is away from the chamber. The unit further comprises a fastening arrangement disposed upon at least one of the first or second buttress for fastening the first and second buttress to a second and first buttress respectively, of
(Continued)

Figure 1A:
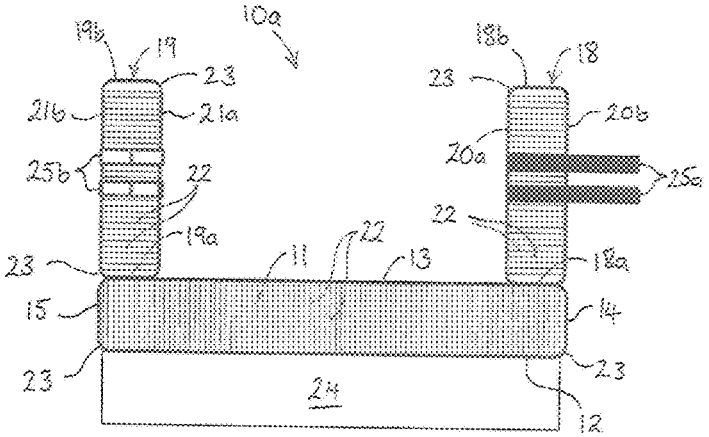

a further structural unit to create the flood defence arrangement.

16 Claims, 5 Drawing Sheets

(58) Field of Classification Search
USPC ..... 405/114, 284, 285, 286, 287
See application file for complete search history.

(56) References Cited

U.S. PATENT DOCUMENTS 5,622,448 A * 4/1997 Baum ..... E02B 13/02 405/114
5,632,573 A 5/1997 Baker
6,012,872 A * 1/2000 Perry ..... E02B 3/108 220/1.6
6,164,870 A * 12/2000 Baruh ..... E02B 3/108 405/114
6,312,192 B1 * 11/2001 Dery ..... E02B 3/108 405/107
6,334,736 B1 * 1/2002 Johnson ..... E02B 3/108 405/107
6,390,154 B1 * 5/2002 Hall ..... E02B 3/108 141/314
6,641,329 B1 * 11/2003 Clement ..... E02B 3/108 405/115
7,431,534 B2 * 10/2008 Harbeck ..... E02B 3/108 405/107
7,651,298 B2 * 1/2010 Boudreaux, Jr. ..... E02B 3/108 405/111
8,235,631 B2 * 8/2012 Adams ..... E02D 29/025 405/107
8,721,221 B2 * 5/2014 Cavenagh ..... E02B 3/108 405/111
2003/0161688 A1 * 8/2003 Frank ..... E02B 3/108 405/115
2007/0140598 A1 * 6/2007 McGillick, Sr. ... B65D 88/1612 383/22
2007/0154264 A1 * 7/2007 Baruh ..... E02B 3/108 405/110
2010/0047019 A1 2/2010 Hvezda et al.
2012/0195687 A1 * 8/2012 Beard ..... E02B 3/108 405/114
2013/0108372 A1 * 5/2013 Abeles ..... E02B 3/108 405/115
2013/0306267 A1 * 11/2013 Feldman ..... E02B 1/00 165/45

FOREIGN PATENT DOCUMENTS

GB 634047 A 3/1950
GB 2411423 A 8/2005
NO WO 03018915 A1 * 3/2003 ..... E02B 3/108

OTHER PUBLICATIONS

Search Report under date of Aug. 21, 2013, in connection with GB1306366.4.

* cited by examiner

INFLATABLE FLOOD DEFENSE STRUCTURAL UNIT AND ARRANGEMENT

CROSS-REFERENCE TO RELATED APPLICATIONS

This application represents the national stage entry of PCT International Application No. PCT/GB2014/051073 filed Apr. 7, 2014, which claims the benefit of Great Britain Patent Application No. 1360366.4, filed on Apr. 9, 2013, the disclosures of which are hereby incorporated by reference in their entirety for all purposes.

This invention present invention relates to an inflatable flood defence structural unit and arrangement.

Conventional flood defences are produced from rigid materials such as concrete or particulate materials such as soil, sand and stone. Such defences are permanent in nature and take up a large volume. They are also time consuming to build so they are either permanent structures erected on site, or if prefabricated, cannot be deployed quickly in an emergency due to their size and weight. Also some structures are susceptible to erosion by flowing flood water.

Inflatable defences have been proposed by others to protect buildings from flooding, for example GB2411423A. However, these are not particularly strong and require a permanent fixing around the perimeter of the building to support the defence. These known inflatable defences are held to the ground or the base of the building because they would otherwise float away, and thus they require a high strength fixing at their base.

We have now devised a defence or water dam which is inflatable and which requires minimal site preparation. Such a defence can then be deployed quickly, where needed, and removed after use, so need not be permanently located.

According to one aspect of the invention, there is provided an inflatable flood defence structural unit comprising:

at least one inflatable chamber comprising a front wall and a rear wall which extend in a substantially parallel orientation, at least one of the front and rear walls providing a water barrier, and a first and second end wall which couple the front and rear walls together at a respective first and second end of the front and rear walls, a first inflatable buttress which is rigidly bonded at a proximal end thereof to the rear wall of the chamber, proximate the first end of the chamber, and which extends in a direction which is away from the chamber, a second inflatable buttress which is rigidly bonded at a proximal end thereof to the rear wall of the chamber, proximate the second end of the chamber, and which extends in a direction which is away from the chamber, and a fastening arrangement disposed upon at least one of the first or second buttress for fastening the first and second buttress to a second and first buttress respectively, of a further structural unit.

In use, the front wall of the unit is arranged to face the flood water or impending flood water such that the buttresses provide a support to the chamber against the force of the flood water, for example. The bonding of the buttresses to the chamber provides a water seal therebetween and thus prevents any water passing between the buttress and the chamber, whereas the fastening arrangement enables the respective buttresses to be held together tightly to provide a substantially water seal along an interface therebetween.

Preferably, the front and rear walls of the chamber are interconnected by a multiplicity of interconnecting members which extend across the chamber. In this way an inflatable defence or water dam can be provided which is rigid when inflated by virtue of the interconnecting members. This rigidity means that the defence can, if necessary, be self-supporting and can be higher than other known inflatable structures. The structure is preferably water fillable without bulging because the interconnecting members hold the front and rear walls in place. This results in a heavy structure which will not lift in the flood water. As a result, it is not essential that the structure is fixed or sealed to the ground.

The first and second buttresses comprise side walls which couple the proximal end of the respective buttress to a distal end of the respective buttress. The side walls of each buttress separately comprise an inner wall which faces inwardly of the unit, substantially toward each other, and an outer wall which face outwardly of the unit, substantially away from each other.

In an embodiment, the outer side wall of the first buttress is substantially aligned with the first end of the chamber and the outer side wall of the second buttress is substantially aligned with the second end of the chamber. In this manner the outer side walls of the first and second buttress extends in a plane comprising the first and second end of the chamber, respectively.

In an alternative embodiment, the outer side wall of the first buttress extends beyond the first end of the chamber, such that the proximal end of the first buttress overhangs the first end of the chamber, and the outer side wall of the second buttress is spaced from the second end of the chamber. Preferably, the spacing of the outer side wall of the second buttress from the second end of the chamber substantially corresponds with the extent to which the outer side wall of the first buttress extends beyond the first end of the chamber.

The unit thus facilitates the joining together of a plurality of units whereby the first end wall of the chamber of one unit may be abutted to the second end wall of a chamber of a neighbouring unit, such that the buttresses may be fastened together using the fastening arrangement to create a watertight seal along the interface therebetween. The alternative embodiment provides for an improved sealing however, since the buttress at the first end of the one unit extends over the rear wall of the chamber of a further unit at the second end thereof. The relative positioning of the first and second buttresses enables the portion of the first buttress to extend over the chamber wall of the further unit, to offset the interface between adjoining buttresses and the interface between the ends walls of the chamber. Accordingly, in addition to providing a labyrinth type seal between the units, the buttress at the first end of the structural unit provides additional support to neighbouring chambers.

Conveniently, the unit comprises a skirt located at a lower region of the chamber, in use extending toward the flood water or impending flood water. The skirt may be arranged to lie on the ground adjacent the chamber and may be rigidly bonded to the chamber to provide a substantially watertight seal between the chamber and the skirt.

The unit preferably further comprises an apron which in use, extends along the front wall of the chamber beyond an end wall of the chamber to extend over the interface between neighbouring chambers. The apron forms a watertight seal with the front walls of the neighbouring chambers under the force of the flood water to further enhance the sealing between the neighbouring units and thus the integrity of the resulting flood defence.

In one embodiment one of the front and rear walls, or both front and rear walls are substantially impermeable to water.

In yet a further embodiment, the first and second buttresses extend away from the chamber in a direction which is substantially perpendicular to the rear wall of the chamber.

It is envisaged that this arrangement will facilitate the creation of a substantially linear flood defence arrangement.

In yet a further alternative embodiment at least one of the first or second buttresses extends in a direction which is substantially acutely orientated with respect to the rear wall of the chamber. It is envisaged that this arrangement will facilitate the creation of a corner within a flood defence arrangement, whereby the arrangement is arranged to prevent flood water entering a defined area. In this respect, at least one of the buttresses extend inwardly of the area, at an inner side of the corner. It is also envisaged however, that at least one of the first and second buttresses may extend at an obtuse angle with respect to the rear wall of the chamber in situations whereby the arrangement is arranged to contain flood water, such as when creating a reservoir. In this respect, the buttress is arranged at an outer side of the reservoir, at an outer side of the corner.

Preferably, the fastening arrangement comprises at least one strap which is rigidly coupled to at least one of the first or second buttress and a tensioning arrangement, such as a ratchet, which is rigidly coupled to the second or first buttress respectively, for controllably pulling the strap to secure neighbouring buttresses together.

Suitably, the or each chamber is formed from so-called drop-stitch material. Said drop stitch material may have two polymer coated fabric sheets separated by a multiplicity of fibres or threads, each being attached to the inner sides of the sheets. The drop stitch material thus has a forest of fibres connecting the two sheets. When inflated with a fluid, the chamber formed from drop stitch material produces a rigid structure.

Preferably the flood defence unit further comprises an inflatable spacer for spacing the chamber of the unit from an adjacent wall in use, for example. Such spacer may comprise a similar structure and be formed of a similar material to the chamber.

The unit may further comprise an inflatable wedge for levelling the chamber upon a slope. The wedge may comprise a similar structure and be formed of a similar material to the chamber.

According to a second aspect of the invention there is provided an inflatable flood defence arrangement comprising a plurality of inflatable flood defence structural units of the first aspect.

The invention extends to any novel feature described herein, or any novel combination of features described.

Figure 1B:
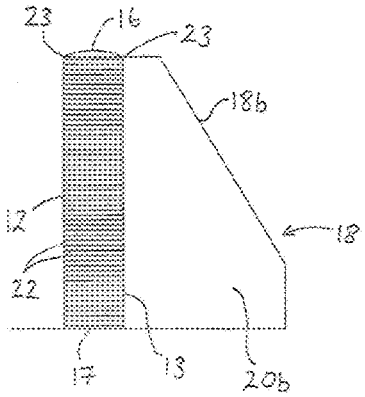
Figure 1C:
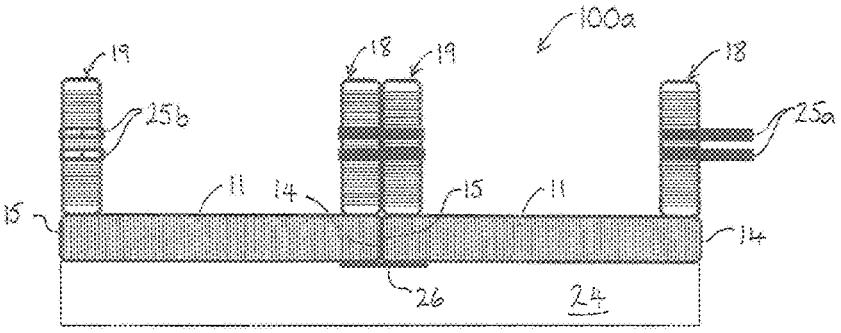
Figure 2A:
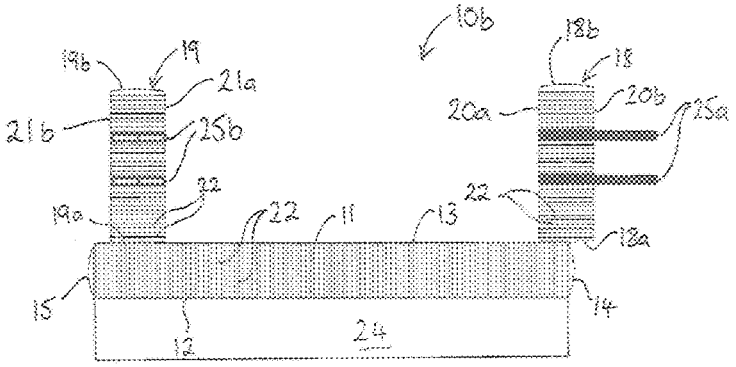
Figure 2B:
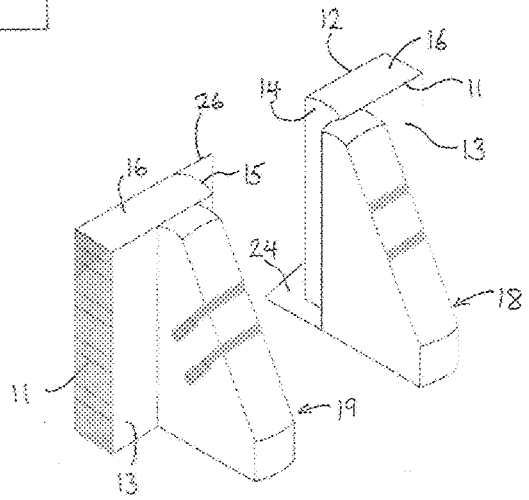

It will be understood that the invention can be put into effect in many ways and by way of illustration only, embodiments of the invention are described below, with reference to the drawings, wherein:

FIG. 1*a* is a plan view of a flood defence structural unit according to a first embodiment of the present invention;

FIG. 1*b* is a side view of the structural unit illustrated in FIG. 1;

FIG. 1*c* is a plan view of a portion of a linear flood defence arrangement according to an embodiment of the present invention;

FIG. 2*a* is a plan view of a flood defence structural unit according to a second embodiment of the present invention;

FIG. 2*b* is a perspective view from the rear of an interface between two structural units of the flood defence arrangement illustrated in FIG. 2*a;*

Figure 2C:
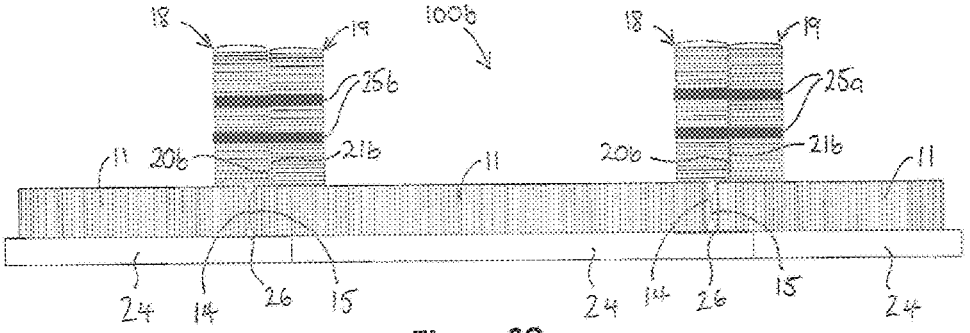

FIG. 2*c* is a plan view of a flood defence arrangement according to an embodiment of the present invention.

Figure 3A:
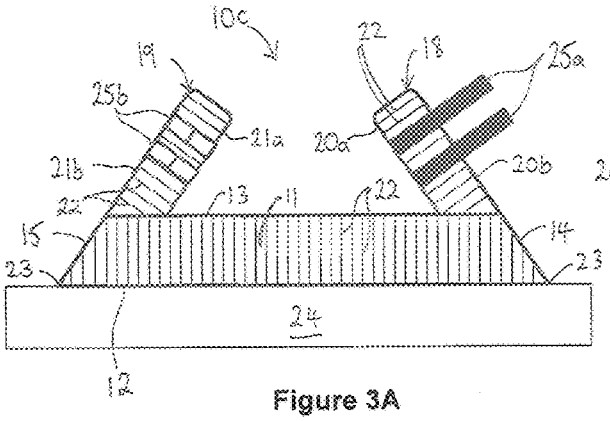
Figure 3B:
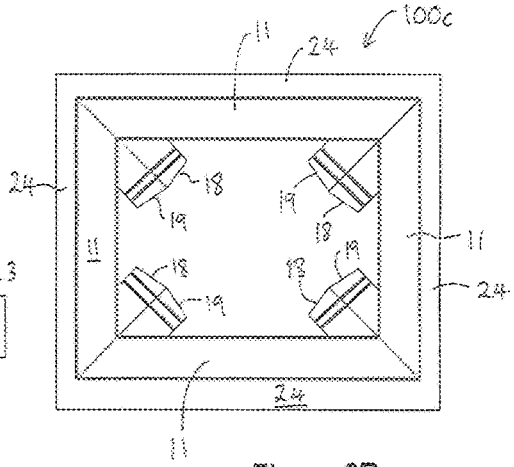

FIG. 3*a* is a plan view of a flood defence structural unit according to a third embodiment of the present invention;

FIG. 3*b* is a plan view of a flood defence arrangement formed using a plurality of flood defence units illustrated in FIG. 3*a;*

Figure 3C:
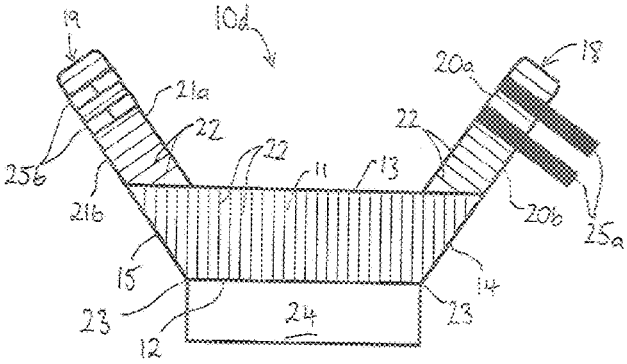
Figure 3D:
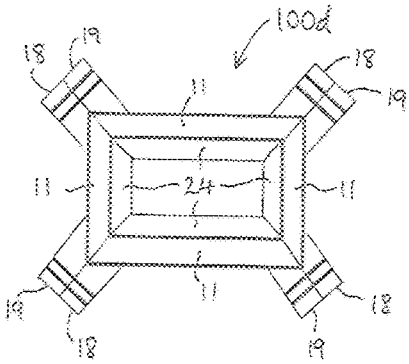

FIG. 3*c* is a plan view of a flood defence structural unit according to a variation of the structural unit of the third embodiment of the present invention;

FIG. 3*d* is a plan view of a flood defence arrangement formed using a plurality of flood defence units illustrated in FIG. 3*c;*

Figure 4:
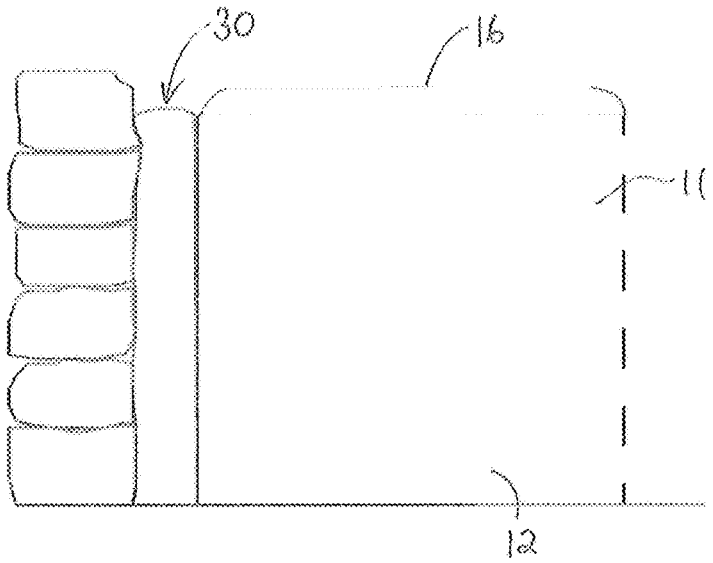
Figure 5:
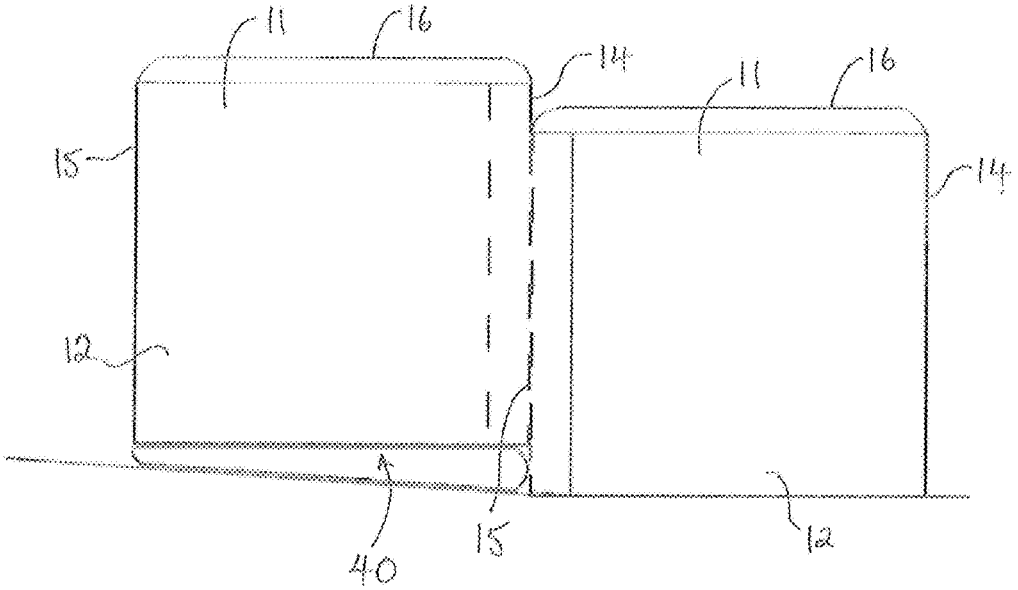

FIG. 4 is front view of spacer disposed between a wall and the structural unit illustrated in FIG. 1; and, FIG. 5 is a schematic illustration of a wedge disposed at the underside of the structural unit illustrated in FIG. 1, located upon a slope.

Referring to FIG. 1*a* of the drawings, there is illustrated a plan view of an inflatable flood defence structural unit 10*a* according to a first embodiment of the present invention, for providing a barrier to flood water and the like. The unit 10*a* comprises an inflatable main chamber 11 comprising a substantially planar, front 12 and rear wall 13, which extend in a substantially parallel orientation. Opposite longitudinal ends of the chamber 11, namely a first and second end, of the chamber comprise a first 14 and second end wall 15 which couple the front and rear walls 12, 13 together to close the first and second end of the chamber 11, whereas the upper and lower regions of the chamber are closed by respective upper 16 and lower end walls 17.

The unit 10*a* further comprises a first 18 and second buttress 19, which are coupled at a proximal end wall 18*a*, 19*a* thereof to the rear wall 13 of the chamber 11. The buttresses 18, 19 comprise side walls 20, 21 which extend from the proximal end wall 18*a*, 19*a* thereof to a respective distal end wall 18*b*, 19*b* thereof in a direction which is substantially perpendicular to the rear wall 13 of the chamber 11. The proximal end wall 18*a*, 19*a* of each buttress 18, 19 comprises a height which substantially corresponds with a height of the chamber 11 and the side walls 20, 21 of each buttress 18, 19 reduce in height in progressing from the proximal end wall 18*a*, 19*a* to the distal end wall 18*b*, 19*b*, such that the distal end wall 18*b*, 19*b* comprises a sloping wall, as illustrated in FIG. 1*b* of the drawings.

The buttresses 18, 19 separately comprise a respective inner side wall 20*a*, 21*a* which faces inwardly of the unit 10*a*, substantially toward each other, and a respective outer side wall 20*b*, 21*b* which face outwardly of the unit 10*a*, substantially away from each other. The buttresses 18, 19 associated with the unit 10*a* of the first embodiment are positioned upon the rear wall 13 of the chamber 11, such that the outer side walls 20*b*, 21*b* of the first and second buttress 18, 19 extend in substantially the same plane as the first and second end walls 14, 15 of the chamber 11, respectively.

The walls of the chamber 11 and each buttress 18, 19 are formed of a woven fibre reinforced polymer sheet material. The front and rear walls 12, 13 of the chamber and opposing side walls 20*a*, 20*b*, 21*a*, 21*b* of each buttress 18, 19 are separately interconnected by a multiplicity of interconnecting polymer fibres or threads 22 which extend across the chamber 11 and each buttress 18, 19, respectively. The material described in this paragraph is known as drop-stitch material. The drop stitch material comprises approximately ten threads per square centimeter, which weave through the interior of the opposing walls, and which forms the woven fibre. The outer surface of the walls of the chamber 11 and buttresses 18, 19 are coated with pvc, in this instance, although other waterproof flexible coatings such as rubber or urethane can be used. The edges of the drop stitch material, for example edges 23 are glued and or heat sealed to provided a substantially airtight unit 10*a*.

The overall structure of the unit 10*a* can be formed into a substantially air and/or watertight compartment, which when inflated provides a rigid structure with inherent mechanical strength to resist bending, tension, and compression. In particular, the unit 10*a* can be water filled and yet still support itself.

The unit 10*a* further comprises a skirt 24 formed of a waterproof material, which extends from a position proximate a lower region of the chamber 11 forwardly of the chamber 11 away from the front wall 12, and is arranged to extend under the flood water to further minimise any flood water passing underneath the chamber 11.

A fastening arrangement 25 is also provided for fastening the unit 10*a* to neighbouring units 10*a* to create a flood defence arrangement or reservoir, for example. In the embodiment illustrated in FIG. 1*a*, the fastening arrangement 25 comprises a pair of straps 25*a* which are rigidly coupled at one end thereof, to the first buttress 18 and a tensioning arrangement such as a pair of ratchets 25*b*, rigidly coupled to the second buttress 19 for separately receiving a strap 25*a* coupled to the first buttress 18 of a further unit 10*a*.

Accordingly, upon positioning a unit 10*a* of the first embodiment adjacent a further unit 10*a*, the free end of the straps 25*a* coupled to the first buttress 18 of one unit 10*a* can be introduced into the corresponding ratchet 25*b* disposed on the adjacent second buttress 19 of the further unit 10*a* and operated to tension the straps 25*a* and urge the outer side wall 20*b* of the first buttress 18 into contact with the outer side wall 21*b* of the second buttress 19 of the further unit 10*a*, to create a linear flood defence arrangement 100*a* according to an embodiment of the present invention, as illustrated in FIG. 1*c* of the drawings. Upon further tensioning the straps 25*a*, a water tight seal can develop between the outer side walls 20*b*, 21*b* of the adjoining buttress 18, 19 and between the first and second end walls 14, 15 of the adjoining chambers 11. Once coupled together, an apron 26 or similar formed of a water proof material may be suitably positioned upon the front wall 12 of neighbouring chambers 11 to extend across the interface. In this respect it is envisaged that the apron 26 may be secured in place using a VELCRO® type fastener (not shown), for example.

Referring to FIG. 2*a* of the drawings, there is illustrated a flood defence structural unit 10*b* according to a second embodiment of the present invention. The unit 10*b* of the second embodiment is substantially the same as the unit 10*a* of the first embodiment and as such like features have been referenced using the same reference numerals.

The unit 10*b* of the second embodiment however, differs from that of the first 10*a* since the buttresses 18, 19 are positioned at a different location upon the rear wall 13 of the chamber 11 compared with the first embodiment. In particular, the first buttress 18 is coupled to the rear wall 13 of the chamber 11 such that the outer side wall 20*b* of the first buttress 18 extends beyond the first end wall 14 of the chamber 11. The first buttress 18 thus partially overhangs the first end wall 14 of the chamber 11. Conversely, the second buttress 19 is coupled to the rear wall 13 of the chamber 11 but is spaced from the second end wall 15 of the chamber 11 by a distance which corresponds to the extent to which the outer wall 20*b* of the first buttress 18 extends beyond the first end wall 14 of the chamber 11, as illustrated in FIG. 2*b* of the drawings.

Accordingly, when neighbouring units 10*b* of the second embodiment are placed in a side-by-side relation as illustrated in FIG. 2*c* of the drawings, and fastened together, the first buttress 18 of one unit 10*b* will partially extend onto the rear wall 13 of the further unit 10*b*. The interface between adjoining buttresses 18, 19 will thus be offset with respect to the interface between the end walls 14, 15 of the adjoining chambers 11. This stepped interface creates a labyrinth type seal between adjacent units 10*b* thereby providing a flood defence arrangement 100*b* according to a second embodiment, which comprises an improved sealing between adjacent units 10*b* compared with the first embodiment of the flood defence arrangement 100*a*, while the first buttress 18 provides support to both chambers 11 at the interface therebetween.

Referring to FIG. 3*a* of the drawings there is illustrated a flood defence structural unit 10*c* according to a third embodiment of the present invention. The unit 10*c* of the third embodiment is substantially the same as the unit 10*a* of the first embodiment and as such like features have been referenced using the same reference numerals.

The unit 10*c* of the third embodiment however, differs from that of the first embodiment, since the first and second buttress 18, 19 extend away from the rear wall 13 of the chamber 11 at an acute angle thereto. This angle may comprise a 45° angle such that upon suitably positioning neighbouring units 10*c*, adjoining chambers 11 extend in substantially perpendicular directions. The adjoining buttresses 18, 19 may then be fastened together to create a flood defence arrangement 100*c* according to a third embodiment, which follows a substantially square path, as illustrated in FIG. 3*b* of the drawings, to extend around the periphery of a property (not shown) for example, to protect against impending flood water. The skilled reader will recognise however, that alternative angles may be used, such as a 60° angle to facilitate the creation of a defence arrangement which follows a hexagonal path.

In this embodiment, it is envisaged that the first and second end walls 14, 15 of the chamber 11 of the unit 10*c* may be similarly angularly orientated to extend in the same plane as the outer walls 20*b*, 21*b* of the first and second buttress 18, 19, respectively, to facilitate the sealing along an interface therebetween.

The acute angular orientation of the buttresses 18, 19 of the unit 10*c* of the third embodiment provide support along an inner side of the respective corner sections of the flood defence arrangement 100*c* when it is desired to keep flood water out of a protected region. In a variation of the flood defence unit 10*c* of third embodiment, there is a provided a flood defence unit 10*d* according to a fourth embodiment as illustrated in FIG. 3*c* of the drawings, in which the buttresses 18, 19 extend away from the rear wall 13 at an obtuse angle thereto, such as 135°, to provide for a flood defence arrangement according to a fourth embodiment 100*d*, as illustrated in FIG. 3*d* of the drawings. The buttresses 18, 19 of the unit 10*d* of a fourth embodiment, extend outwardly of the arrangement 100*d*, at an outer side of the corner sections of the arrangement 100*d*, to provide support to the chambers 11 when the arrangement 100*d* is used to contain water within a region, such as when creating a reservoir. Again however, the skilled reader will recognise that other obtuse angles may be used, such as 120°, when creating a hexagonal reservoir.

When the flood defence units 10*a-c* of the above described embodiments are used to create a barrier to flood water for example, units 10*a*, 10*b*, 10*c* of the first, second and/or third embodiment are deployed and inflated initially with a gas, e.g. air or CO2, to form their shape. The air will be released from a compressed gas tank (not shown) inside the chamber 11 and/or buttresses 18, 19 of the respective units 10, using a lever (not shown) operable from outside the respective unit 10. The units 10 are then suitably positioned relative to each other to form the desired flood defence and fastened together using the fastening arrangement 25 to create a water tight seal between adjoining units 10. It is evident that by combining units of various embodiments, it is possible to create a flood defence arrangement 100 which follows a desired contour or path.

The resulting flood defence affords some protection from flooding, but the resulting defence arrangement 100 is not particularly heavy and so has a tendency to lift if not held down in flood water. Thus, although not essential, the units 10 may then be partially or completely filled with water, particularly if it seems likely that flooding will take place following an initial warning. The water can suitably be added to the units 10 from a hose pipe (not shown) via an inlet valve (not shown) disposed upon a rear wall 13 of the chamber 11, while air is allowed to escape in a controlled manner from the top of the units 10 via a respective escape valve (not shown).

Alternatively, if no hosed water supply, or other water supply is available, a one-way valve (not shown) can be employed proximate the base of the chamber 11 or each unit 10 which allows flood water to enter the chamber 11, but not escape. Since the pressure of the flood water is likely to be no more than atmospheric, then compressed gas in the chambers 11 can be allowed to escape to encourage the flow water to enter the chambers 11. If the gas is allowed to escape via the escape valve (not shown) at just above atmospheric pressure then, as the flood water rises, a higher level of flood water compared to the water in the chambers 11 of the defence arrangement 100 will cause the water to flow into the chambers 11 and displace the gas in the chambers 11.

In situations whereby the chambers 11 of one or more units 10 of the defence arrangement 100 may pass close to a building or other formation, such as a wall 27, the formation may be utilised to further support the respective chamber 11, by positioning an inflatable spacer 30 therebetween, as illustrated in FIG. 4 of the drawings. It is envisaged that the spacer 30 may be formed of a similar material and comprise similar features, to the chamber 11 of the units 10 of the above described embodiments. Similarly, when erecting the flood defence arrangement 100 on sloping ground, an inflatable wedge 40 may be placed at the underside of one or more units 10, as illustrated in FIG. 5 of the drawings, to level the units 10. It is also envisaged that the wedge 40 may be formed of a similar material and comprise similar features, to the chamber 11 of the units 10 of the above described embodiments.

Once the defence arrangement 100 has been erected, aprons 26 may then be secured along front wall 12 of the chambers 11, across the interfaces therebetween and the skirt 24 from each unit 10 may be suitably extended forwardly of the chamber 11 toward the impending flood water. From the foregoing it is evident that the flood defence structural units 10 and arrangements 100 provide for a rapid defence against flood water. The skilled reader will recognise however, that the embodiments described above are merely examples of the invention. Modifications, variants, equivalents, alternatives etc will be readily apparent to the skilled addressee.

The invention claimed is:

1. An inflatable flood defense structural unit comprising:

at least one inflatable chamber comprising a front wall and a rear wall which extend in a substantially parallel orientation, at least one of the front and rear walls providing a water barrier, and a first and second end wall which couple the front and rear walls together at a respective first and second end of the front and rear walls, a first inflatable buttress which is rigidly bonded at a proximal end thereof to the rear wall of the chamber, proximate the first end of the chamber and which extends in a direction which is away from the chamber, a second inflatable buttress which is rigidly bonded at a proximal end thereof to the rear wall of the chamber, proximate the second end of the chamber, and which extends in a direction which is away from the chamber, the first and second buttresses further comprising side walls which couple the proximal end of the respective buttress to a distal end of the respective buttress, the side walls of each buttress separately comprising an inner wall which faces inwardly of the unit, substantially toward each other, and an outer wall which face outwardly of the unit, substantially away from each other, the unit further comprising a fastening arrangement having at least one strap which is rigidly coupled to at least one of the first or second buttress so as to directly fasten the first or second buttress to a second or first buttress respectively, of a further structural unit such that in use, the outer side wall of the first and second buttress is arranged to contact an outer side wall of the second and first buttress of the further unit, and wherein the outer side wall of the first buttress extends beyond the first end of the chamber, such that the proximal end of the first buttress overhangs the first end of the chamber.

2. A unit according to claim 1, wherein the front and rear walls of the chamber are interconnected by a multiplicity of interconnecting members which extend across the chamber.

3. A unit according to claim 1, wherein the outer side wall of the first buttress is substantially aligned with the first end of the chamber.

4. A unit according to claim 3, wherein the outer side of the second buttress is substantially aligned with the second end of the chamber.

5. A unit according to claim 1, wherein the outer side wall of the second buttress is spaced from the second end of the chamber.

6. A unit according to claim 5, wherein the spacing of the outer side wall of the second buttress from the second end of the chamber corresponds with the extent to which the outer side wall of the first buttress extends beyond the first end of the chamber.

7. A unit according to claim 1, wherein the first and second buttresses extend away from the chamber in a direction which is substantially perpendicular to the rear wall of the chamber.

8. A unit according to any of claim 1, wherein at least one of the first or second buttresses extends in a direction which is substantially acutely orientated with respect to the rear wall of the chamber.

9. A unit according to claim 1, wherein at least one of the first and second buttresses extend at an obtuse angle with respect to the rear wall of the chamber.

10. A unit according to claim 1, further comprising a skirt disposed at a lower region of the chamber, in use extending toward the flood water or impending flood water.

11. A unit according to claim 10, wherein the skirt is rigidly bonded to the chamber to provide a substantially watertight seal between the chamber and the skirt.

12. A unit according to claim 1, further comprising an apron which in use, extends along the front wall of the chamber beyond an end wall of the chamber to extend over the interface between a neighboring chamber.

13. A unit according to claim 1, wherein the fastening arrangement comprises a tensioning arrangement which is rigidly coupled to the second or first buttress respectively.

14. A unit according to claim 1, further comprising an inflatable spacer for spacing, in use, the chamber of the unit from a formation.

15. A unit according to claim 1, further comprising an inflatable wedge for leveling the chamber upon a slope.

16. An inflatable flood defense arrangement comprising a plurality of flood defense structural units according to claim 1.

* * * * *